US007541803B2

(12) United States Patent
Schäfer et al.

(10) Patent No.: US 7,541,803 B2
(45) Date of Patent: Jun. 2, 2009

(54) DEVICE AND METHOD FOR DETERMINING THE ANGLE OF ROTATION BETWEEN A CAMSHAFT AND A CRANKSHAFT IN AN INTERNAL COMBUSTION ENGINE

(75) Inventors: Jens Schäfer, Herzogenaurach (DE); Martin Steigerwald, Erlangen (DE)

(73) Assignee: Schaffler KG, Herzogenaurach (DE)

( * ) Notice: Subject to any disclaimer, the term of this patent is extended or adjusted under 35 U.S.C. 154(b) by 544 days.

(21) Appl. No.: 10/563,998

(22) PCT Filed: Jun. 8, 2004

(86) PCT No.: PCT/EP2004/006144

§ 371 (c)(1),
(2), (4) Date: Jan. 9, 2006

(87) PCT Pub. No.: WO2005/012698

PCT Pub. Date: Feb. 10, 2005

(65) Prior Publication Data

US 2007/0101956 A1 May 10, 2007

(30) Foreign Application Priority Data

Jul. 9, 2003 (DE) ..... 103 30 872

(51) Int. Cl.
*G01B 7/30* (2006.01)
*F01L 1/34* (2006.01)

(52) U.S. Cl. ..... 324/207.25; 123/90.15

(58) Field of Classification Search ..... 324/207.25, 324/207.2; 702/150, 151; 123/90.15, 90.17
See application file for complete search history.

(56) References Cited

U.S. PATENT DOCUMENTS 3,978,829 A 9/1976 Takahashi et al.

(Continued)

FOREIGN PATENT DOCUMENTS

DE 41 10 195 2/2000

(Continued)

OTHER PUBLICATIONS

Chalupa, Leos: Low Cost High Efficiency Sensorless Drive for Brushless DC Motor Using MC68HC(7)05MC4. IN: Motorola, 1999, AN1627/D, pp. 1-27; S. 1, 2.

*Primary Examiner*—Kenneth J Whittington
(74) *Attorney, Agent, or Firm*—Volpe and Koenig, P.C.

(57) ABSTRACT

A device and a method for determining an angle of rotation between a camshaft (5) and a crankshaft of an internal combustion engine is provided, the device including a camshaft regulator provided with an electronic regulator, and a device for determining the position of the angle of rotation of the camshaft and the crankshaft. A crankshaft triggering wheel provided with reference and trigger marks is fixed to the crankshaft for determining the position angle of rotation of the crankshaft, and an electromechanical camshaft regulator is provided, including a triple-shaft gearbox (1), the first shaft (3) being connected to the camshaft (5) in a rotationally locked manner, the second shaft (4) being connected to the crankshaft via a camshaft drive wheel, and the third shaft, as the regulating shaft (6), being connected to a permanent magnet rotor (8) of a BLDC motor (2) which has a stator (9) that is fixed to the housing, and an electronic commutation that can be controlled by commutation signals that are used both for determining the position of the angle of rotation of the camshaft (5), and together with the signals of the crankshaft trigger wheel, for calculating the angle of rotation between the camshaft (5) and the crankshaft.

4 Claims, 1 Drawing Sheet

U.S. PATENT DOCUMENTS

| | | | | |
|---|---|---|---|---|
| 6,129,061 | A | 10/2000 | Okuda et al. | |
| 6,249,096 | B1 | 6/2001 | Shin | |
| 6,505,587 | B1 | 1/2003 | Scheidt | |
| 6,681,741 | B2 * | 1/2004 | Majima et al. | 123/399 |

FOREIGN PATENT DOCUMENTS

| | | |
|---|---|---|
| DE | 102 20 687 | 11/2003 |
| DE | 103 17 607 | 11/2003 |
| EP | 0 918 142 | 10/2003 |

* cited by examiner

DEVICE AND METHOD FOR DETERMINING THE ANGLE OF ROTATION BETWEEN A CAMSHAFT AND A CRANKSHAFT IN AN INTERNAL COMBUSTION ENGINE

BACKGROUND

The invention relates to a device and to a method for determining the angle of rotation of a camshaft in relation to the crankshaft of an internal combustion engine.

A camshaft regulator is used to maintain an exact desired angular position course of the adjustment angle of the camshaft. Due to disturbances, such as fluctuations of the driving torque of the camshaft, deviations between the desired angle course and the actual angle course arise in practical motor operation. Reducing these deviations can lead to reduced pollutant emissions and fuel consumption, increased engine output and torque, and also reduced onboard power supply loading during engine startup and reduce engine rpm's at low idle. Especially important is the maintenance of the optimum adjustment angle during engine startup in order to reduce the high pollutant emissions in this operating state.

In DE 43 17 527 A1, a method for determining the angle of rotation $\Delta\phi$ of a camshaft in relation to the crankshaft of an internal combustion engine is disclosed, which features a hydraulic camshaft regulator with an electronic regulator and means for determining the angular position of the camshaft in relation to the crankshaft.

In this system, for regulating the angle of rotation $\Delta\phi$ of the camshaft, the rpm and the angular position of the crankshaft and camshaft are detected. Trigger wheels, which are mounted on the crankshaft and camshaft, are used for this purpose. Each sensor detects the corresponding reference and trigger marks, which are used in the electronic regulator for determining the rpm and angular position of the shafts and for calculating the angle of rotation $\Delta\phi$.

Disadvantages in this solution are the necessary expense and the insufficient accuracy of the signal detection, as well as the relatively slow and imprecise setting of the angle of rotation $\Delta\phi$, which is possible only in the normal engine operation, for hydraulic camshaft regulators.

SUMMARY

Therefore, the invention is based on the objective of creating the ability to determine the angle of rotation $\Delta\phi$ between a camshaft and the crankshaft of an internal combustion engine with high speed and accuracy.

This objective is met by the features of the invention.

In comparison with hydraulic camshaft regulators, the electronic camshaft regulator offers the advantage of rapid and exact setting and fixing of the angle of rotation $\Delta\phi$ of the camshaft. This applies to the entire operating range of the internal combustion engine, including the startup phase.

The BLDC (brushless DC) motor operates with electronic commutation, so that friction and wear on the brushes and commutators are eliminated. The low moment of inertia and the high torque of the permanent magnet rotor enable high setting speeds of the BLDC motor.

The electronic commutation is realized by commutation signals, which are generated by the rotational movement of the permanent magnet rotor in sensors and which are processed in a commutation computer. Here, one sensor is necessary for each of the three phases of the stator.

The commutation signals are also suitable for determining the angular position of the camshaft and, together with the reference and trigger mark signals of the camshaft trigger wheel, for determining the angle of rotation $\Delta\phi$ of the camshaft. In this way, the otherwise necessary trigger wheel of the camshaft and its sensor are eliminated. Therefore, costs, installation space, and weight are saved.

As sensors for generating the commutation signals, known Hall and reluctance sensors or optical, inductive, or capacitive sensors can be utilized.

Especially advantageous is the generation of the commutation signals by self-induction in the three phases of the stator. Thus, the possible elimination of the sensors reduces the costs and the susceptibility to interruptions, especially as a result of high temperatures in the BLDC motor.

The installation space requirements of the sensors and their structural expense are therefore reduced, such that these can be built into components of the BLDC motor, which rotate at the engine rpm, such as, e.g., bearing or sealing rings.

Problem-free startup and acceleration of the internal combustion engine is therefore guaranteed, in that a RAM or an EPROM are provided in a controller or an active, memory-equipped Hall sensor, which store or make recognizable the count and thus the position of the camshaft at a standstill or during startup of the internal combustion engine.

The active Hall sensors respond when voltage is applied to the north or south pole and thus recognize the position of the camshaft directly after activation of the ignition lock or when the internal combustion engine is started. In this way, the desired set position can also be set or held during the startup process of the internal combustion engine.

The counter data stored in the memory devices can be used to recognize and correct the position of the camshaft even when the engine is at a standstill. In both cases, fuel consumption and pollutant emissions are minimized in the critical startup phase.

In general, when the internal combustion engine is turned off, the angular position information is lost. Then, when the engine is started, the rotor must be resynchronized to the crankshaft. If the crankshaft sensor registers a uniquely identifiable event, for example, the lack of a tooth on the starter crown gear, then the position of the crankshaft is recognized at a fixed reference point, for example, at the top dead center point of the first cylinder. If a tooth of the trigger wheel passes the camshaft on the camshaft sensor, then the position of the camshaft on a cam is uniquely recognized, for example, the maximum stroke of the first cam. From the elapsed time between the event "lack of tooth on crankshaft" and the event "trigger wheel tooth camshaft passes camshaft sensor," the angular position of the camshaft relative to the crankshaft can be determined. The controller determines the elapsed time from the set "time marks" at the events. The time marks are set or generated by a high frequency oscillator quartz. The rotor position can be determined uniquely at the latest at this time by means of the fundamental transmission equation.

A second type of synchronization can be achieved by moving the regulator to the mechanical end stop. If this position is reached, then the position of the camshaft relative to the crankshaft and thus also the rotor position is known by the triple-shaft equation. This works even without a camshaft sensor. A disadvantage in this type of synchronization is the influence of the control drive expansion by temperature changes and/or aging of the belt or lengthening of the timing chain on the accuracy of the detection of the camshaft position.

It can be that a so-called resolver or a component that is functionally equivalent to the resolver is attached to the crankshaft in place of the crown gear. The resolver is, in principle, a high-resolution shaft encoder, which enables the detection of the angle or rpm of the crankshaft signal.

In place of the three Hall sensors or the mentioned alternative sensors, a resolver can be used as the basis for commutation of the BLDC motor. When the rotor rotates, this can reach not only a signal frequency of "number of Hall sensors x number of poles" but instead a significantly higher resolution. The resolver function can be integrated equally into the already mentioned "sensor support" or "sensor sealing ring" component.

The object is also solved by the features of the method according to the invention. The additive and multiplicative linking of the commutation and trigger signals offers an inexpensive way to calculate the angle of rotation$\Delta\phi$.

One advantageous configuration of the invention is provided in that the angle of rotation $\Delta\phi$ is calculated based on the following count-based relationship:

$$\Delta\phi = \left(\left(Number_{Referencemark} + \frac{Number_{Trigger}}{Total_{Trigger}}\right) \times \frac{1}{2} - \frac{Number_{Hallsignal}}{Number_{magnetpole}}\right) \times \frac{360}{i}$$

Where:

$Number_{Hallsignale}$=number of signals of a Hall sensor, which results from the quotient of the number of signals of all Hall sensors and the number of Hall sensors;

$Number_{Magnetpole}$=number of magnetic poles of the permanent magnet rotor;

$Number_{Referenzemark}$=number of reference marks of the crankshaft trigger wheel;

$Total_{Trigger}$=number of trigger marks on the crankshaft trigger wheel;

$Number_{Trigger}$=number of counted trigger marks since the last reference mark;

i=gear transmission ratio between regulator shaft and camshaft for fixed chain wheel.

It is advantageous if the trigger mark signal detected after passage of one reference mark is deleted after reaching the next reference mark. This prevents adjustment errors being produced due to count errors. In addition, this limits the necessary size of the memory.

An advantageous refinement of the invention is provided in that a change in the direction of rotation of the BLDC motor is determined by evaluating the resulting change of the commutation signals, whereby these are differentiated and the differential of the commutation signals of one of the three Hall sensors is combined with the status (High/Low) of the differential of the commutation signals of the two other Hall sensors. In this way, a change in the direction of rotation is recognized through corresponding software.

The time-based determination of the angle of rotation $\Delta\phi$ according to the relationship $$\Delta\phi = \int \frac{(n_{kw} \div 2 - n_{vw})}{i} \times dt$$

requires significantly less memory space than the count-based determination.

It is also advantageous for a fast and exact calculation of the angle of rotation $\Delta\phi$ if the count-based and the time-based determination of the angle of rotation $\Delta\phi$ can be combined.

Because the camshaft assumes a reference position, for example, a basis position with mechanical stop, for count-based or time-based determination of the angle of rotation $\Delta\phi$ at regular intervals or because it is synchronized with an edge of the camshaft trigger wheel, in order to zero the counter, an exact calculation of the angle of rotation $\Delta\phi$ is guaranteed for reduced memory size.

savings in memory space and computing capacity are also achieved in that for a whole-number ratio of the crankshaft signal to at least one sensor signal of the regulator shaft, the phase position of the camshaft relative to the crankshaft is determined by evaluating the difference of these signals in a position regulator, which preferably works with a locked camshaft or crankshaft rpm. As long as there is no adjustment on the regulating gearbox, this rotates as a unit, so that the rpm difference of zero must be produced. If an adjustment is performed by the regulating gearbox, a difference between the regulating shaft signals and the crankshaft signals is produced. Because the gearbox is fixed in its transmission ratios, a unique phase position of the camshaft can be allocated to each signal difference. Thus, the work with the signal difference instead of the sum of the individual signals requires less memory capacity and computing power. The camshaft signal can also be detected and processed with a computer for increasing the resolution of the phase position or for a plausibility check of the phase position.

It is also advantages that the camshaft is adjustable into any desired position by a spinning BLDC motor or by after-running of a controller after the ignition is turned off and the internal combustion engine stops. In this way, the time loss when the engine is started due to startup of the desired angle of rotation $\Delta\phi$ of the camshaft is eliminated, so that immediate startup with the optimum angle of rotation $\Delta\phi$ is guaranteed.

BRIEF DESCRIPTION OF THE DRAWING

Additional features of the invention result from the following description and from the drawing, in which an embodiment of the invention is shown schematically.

DETAILED DESCRIPTION OF THE PREFERRED EMBODIMENTS

Figure 1:
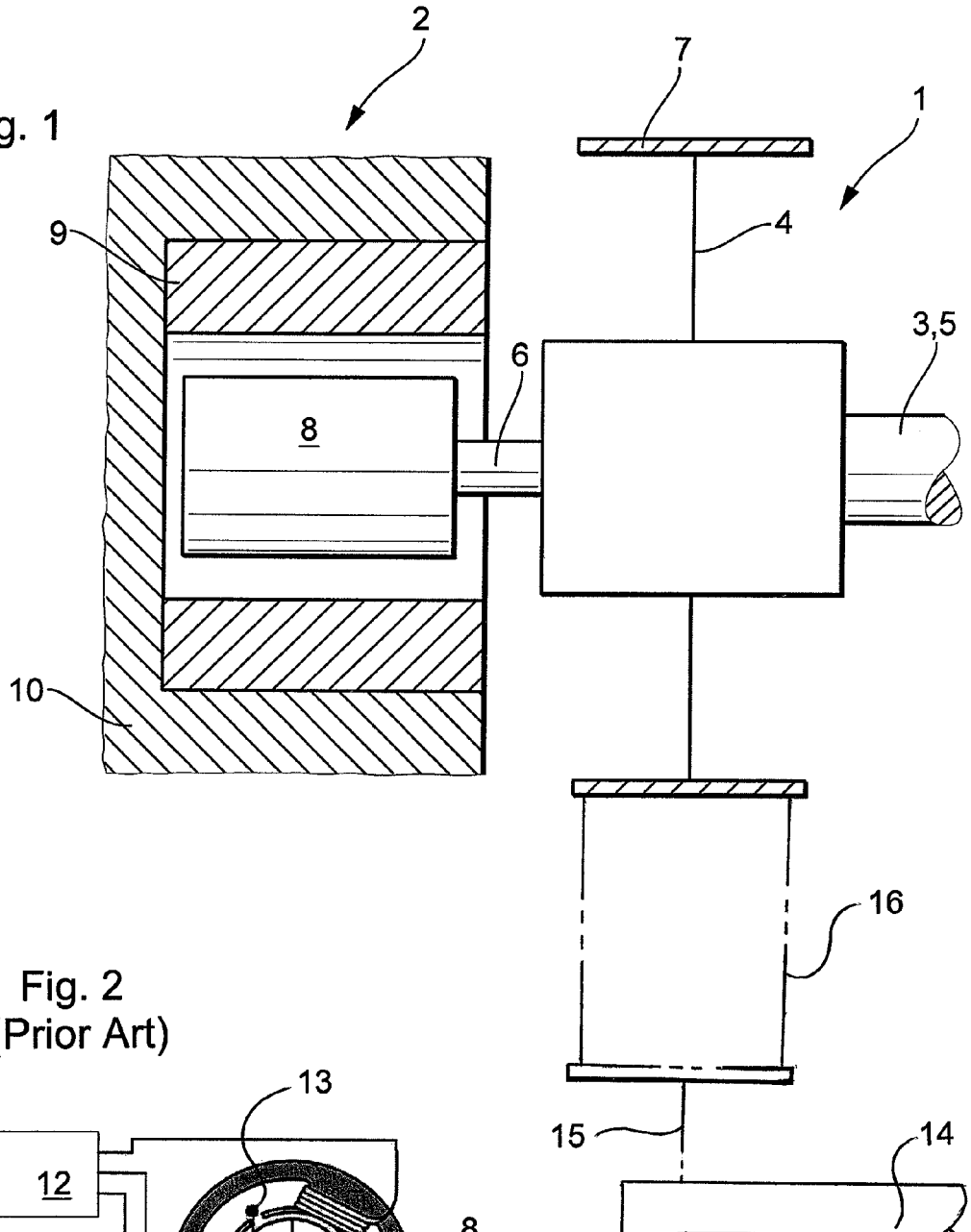
FIG. 1 shows an electromechanical camshaft regulator with a regulating gearbox embodied as a triple-shaft gearbox and with an electric regulating motor.

The single drawing shows the basic layout of an electromechanical camshaft regulator, in which the solution according to the invention has been used.

The camshaft 5 is connected to a crankshaft 14 by a triple-shaft regulating gearbox 1. The first shaft 3 of the regulating gearbox 1 is locked in rotation with the camshaft 5, the second shaft 4 is connected with the crankshaft 14 by a chain or toothed belt 16 extending between a crankshaft wheel 15 (which can act as a trigger wheel) and a camshaft driving wheel 7, and a regulating shaft 6 is provided as a third shaft with a permanent magnet rotor 8 of a regulating motor embodied as a BLDC motor 2 (brushless DC motor). A stator 9 of the motor 2 is connected rigidly to a housing 10 of the internal combustion engine. The stator is embodied as a three phase stator.

Figure 2:
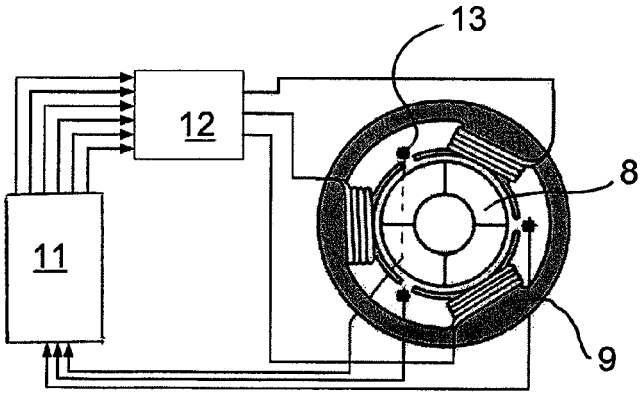
Fig. 2 (Prior Art)
FIG. 2 shows a BLDC motor using three Hall effect sensors with electronic commutation in accordance with the prior art.

As shown in FIG. 2, where a known BLDC motor is shown, the BLDC motor 2 is commutated electronically by an electronic commutation control 11 that provides commutation signals to the driver 12. The commutation signals are triggered by the rotational movement of the permanent magnet 8 in three Hall sensors 13, which are allocated to the three phases of the stator 9.

The permanent magnet rotor 8 is magnetized on the periphery with multiple poles. For each rotation, a bipolar Hall sensor outputs one signal for each pole, i.e., for an eight-pole magnet, eight signals. For unipolar Hall sensors, only half the number of signals is output.

Because the camshaft 5 is connected directly via the triple-shaft gearbox 1 to the BLDC motor 2, the position of the camshaft 5 can be determined with the Hall sensors 13 or their commutation signals as follows:

The fundamental rpm equation of a triple-shaft gearbox reads as follows:

$$n_{vw}-n_{NW}\times i+n_{Kette}\times(i-1)=0 \tag{1}$$

where $n_{NW}$=rpm of camshaft 5

$n_{Kette}$=rpm of camshaft driving wheel 7

$n_{VW}$=rpm of regulating shaft 6 i=gear transmission ratio.

Expressed in angles, the following applies:

$$\phi_{vw}-\phi_{NW}\times i+\phi_{Kette}\times(i-1)=0 \tag{2}$$

with:

$\phi_{NW}$=traversed angle of camshaft 5;

$\phi_{Kette}$=traversed angle of camshaft driving wheel 7;

$\phi_{VW}$=traversed angle of regulating shaft 6.

For the adjustment angle, the following applies:

$$\Delta\phi=\phi_{Kette}-\phi_{Camshaft} \tag{3}$$

(2) into (3) results in:

$$\Delta\phi=(\phi_{Kette}-\phi_{vw})\div i \tag{4}$$

For the traversed angles of the individual shafts, the following applies:

$$\phi=U\times 360° \tag{5}$$

with:

U=number of rotations of the appropriate shaft.

(5) into (4) results in:

$$\Delta\phi=(U_{Kette}-U_{VW})\times 360°\div 1 \tag{6}$$

The number of rotations of the regulating motor can be calculated directly from the number of Hall signals of a Hall sensor 13 as follows:

$$U_{VW}=\frac{Number_{Hallsignal}}{Number_{Magnetpole}} \tag{7}$$

The number of Hall signals results from the quotient of the number of signals of all Hall sensors 13 and the number of Hall sensors 13.

A reference mark, with which the number of rotations of the camshaft driving wheel 7 can be determined, is located on a crankshaft trigger wheel 15 for recognizing the cylinder 1:

$$U_{Kette}=\left(Number_{Referencemark}+\frac{Number_{Trigger}}{Total_{Trigger}}\right)\div 2 \tag{8}$$

with:

$Total_{Trigger}$=number of trigger marks on the crankshaft trigger wheel $Number_{Trigger}$=number of determined trigger marks since the last reference mark.

The number of determined trigger marks is set to zero again after a new reference mark is reached.

With (7) and (8) into (6), the adjustment angle $\Delta\phi$ can be determined directly from the number of Hall signals and the number of reference and trigger mark signals of the crankshaft trigger wheel:

$$\Delta\phi=\left[\left(Number_{Referencemark}+\frac{Number_{Trigger}}{Total_{Trigger}}\right)\div 2-\frac{Number_{Hallsignal}}{Number_{Magnetpole}}\right]\times\frac{360°}{i} \tag{9}$$

For regulating the angle of rotation $\Delta\phi$, both the Hall signals of the BLDC motor 2 and also the reference and trigger mark signals of the crankshaft trigger wheel 15 are added. Thus, the current position of the camshaft 5 can always be determined via the equation (9).

In order to prevent adjustment errors due to count errors, the camshaft 5 is moved into a reference position, e.g., a base position with a mechanical stop, the counter is zeroed, and adding is started again, at regular intervals and for suitable driving conditions. Although very large numbers must be handled by the high counting, memory space is saved through the zeroing.

The direction of rotation of the BLDC motor is also detected by means of the Hall sensors 13, because this can change according to the adjustment direction. In this case, the Hall signals are subtracted from the counter.

The direction of rotation can be determined by evaluating the sequence of the signals of the three Hall sensors. Detection is possible only when one of the Hall signals changes. In order to recognize this condition, the signals of the Hall sensors ABC are differentiated. The direction of rotation can be determined when the differential is combined with the status (High/Low) of another signal.

When the internal combustion engine is turned off, the counts are stored in a RAM or EPROM of the controller, so that when the engine is started, the current position of the camshaft is known immediately. In addition, it is advantageous to use active, memory-equipped Hall sensors, which react when voltage is applied to the north or south pole.

Because the position of the camshaft 5 is recognized directly after the ignition lock is activated or when the crankshaft and camshaft 5 start to rotate, especially for the use of an active, memory-equipped Hall sensor, the desired adjustment position can also be set and held during the startup process of the internal combustion engine. This is advantageous due to the associated reduction of fuel consumption and exhaust gas emissions. In the same extent, any desired adjustment position can also be traversed during the turning off of the vehicle after turning the ignition lock. This is achieved through an active after-running of the BLDC motor 2 or of the controller. Here, the prevention of time loss for the traversal of the desired angle of rotation when the engine is started is advantageous.

Because a large amount of memory space is required for the previously described count-based variant of the angle of rotation determination, a variant is described below, which involves a time-based determination of the angle of rotation.

In the time-based variant, the angle of rotation determination is realized by means of the rpm difference between the crankshaft and the regulating shaft 6.

The rpm of the crankshaft is determined by determining the time that elapses between two or more crankshaft trigger marks. Because the trigger marks have a fixed angle relative to each other, the speed is produced:

$$n_{KW}=\Delta\phi_{Triggermarks}\div\Delta t$$

with:

$n_{KW}$=crankshaft rpm;

$\Delta\phi_{Triggermarks}$=angle between two or more crankshaft trigger marks;

$\Delta t$=time elapsed between two or more trigger marks.

The rpm of the BLDC motor 2 can be determined by the time, which elapses between two or more signals on the regulating shaft.

$$n_{VW}=\Delta\phi_{Magnetpole}\div(\Delta'\times k)$$

with:

$\Delta\phi_{Magnetpole}$=angle between two magnet poles;

$\Delta t'$=time elapsed between two signals on the regulating shaft;

k=constant, which includes the number of sensor signals between two magnet poles.

The adjustment angle can be determined as follows:

$$\Delta\phi=\int\frac{n_{kw}\div 2-n_{vw}}{i}\times dt$$

For the time-based angle of rotation determination, a run-up of a reference mark to the zero of the system is also conceivable. However, it is also conceivable that the synchronization between the crankshaft, the regulating shaft, and the camshaft is realized in the way already described above. Likewise, a combination of count-based and time-based angle of rotation determination is also possible.

LIST OF REFERENCE SYMBOLS

1 Triple-shaft gearbox
2 BLDC motor
3 First shaft
4 Second shaft
5 Camshaft
6 Regulating shaft
7 Camshaft driving wheel
8 Permanent magnet rotor
9 Stator
10 Housing
11 Electronic commutation control
12 Driver
13 Hall sensors
14 Crankshaft
15 Crankshaft wheel/Crankshaft trigger wheel
16 Chain or toothed belt

The invention claimed is:

1. Device for determining an angle of rotation $\Delta\phi$ between a camshaft (5) and the crankshaft of an internal combustion engine, comprising a camshaft regulator and means for determining the angle of rotation position of the camshaft (5) and the crankshaft, a crankshaft trigger wheel with reference and trigger marks is fixed to the crankshaft for determining the angle of rotation position of the crankshaft and a triple-shaft gearbox (1), having a first shaft (3) that is locked in rotation with the camshaft (5), a second shaft (4) that is connected via a camshaft driving wheel (7) to the crankshaft, and a third shaft as a regulating shaft (6) that is connected to a permanent magnet rotor (8) of a BLDC motor (2), wherein the BLDC motor (2) has a housing-fixed stator (9) and an electronic commutation, which is controlled through commutation signals, which are used simultaneously for determining an angle of rotation position of the camshaft (5) and together with signals of the crankshaft trigger wheel for calculating the angle of rotation $\Delta\phi$ between camshaft (5) and crankshaft.

2. Device according to claim 1, wherein the crankshaft trigger wheel is formed as a ring gear or resolver and the commutation signals can be generated by Hall sensors or reluctance sensors, through optical, inductive, or capacitive sensors, or without sensors through self-induction through phases of the stator (9).

3. Device according to claim 2, wherein the sensors can be installed in components of the BLDC motor (2).

4. Device according to claim 3, wherein a RAM or an EPROM are provided in a controller or an active, memory-equipped Hall sensor, which store or make detectable counts and thus a position of the camshaft (5) in standstill or during startup of the internal combustion engine.

* * * * *